US007154380B1

(12) United States Patent
Tarrab, Jr.

(10) Patent No.: US 7,154,380 B1
(45) Date of Patent: Dec. 26, 2006

(54) POWER DISTRIBUTION AND TIMING DEVICE

(76) Inventor: George Tarrab, Jr., 3192 China Fir Pl., Simi Valley, CA (US) 93065

( * ) Notice: Subject to any disclaimer, the term of this patent is extended or adjusted under 35 U.S.C. 154(b) by 209 days.

(21) Appl. No.: 10/998,247

(22) Filed: Nov. 24, 2004

(51) Int. Cl.
*G08B 1/00* (2006.01)

(52) U.S. Cl. ..... 340/309.16; 340/568.3; 725/29; 463/29; 368/10; 348/730; 273/148 B; 711/163

(58) Field of Classification Search ..... None
See application file for complete search history.

(56) References Cited

U.S. PATENT DOCUMENTS 3,484,775 A * 12/1969 Cline ..... 340/517
3,537,095 A * 10/1970 Cones ..... 340/517
3,581,029 A * 5/1971 Noiles ..... 200/38 DA
3,833,779 A * 9/1974 Leone ..... 200/33 R
3,879,332 A * 4/1975 Leone ..... 200/33 R
3,959,790 A * 5/1976 Schuyler ..... 340/568.3
4,121,201 A * 10/1978 Weathers ..... 340/524
4,484,220 A * 11/1984 Beetner ..... 348/730
4,510,623 A 4/1985 Bonneau et al.
4,588,901 A * 5/1986 Maclay et al. ..... 307/141
4,712,019 A * 12/1987 Nilssen ..... 307/141
5,125,492 A 6/1992 Treleaven et al.
5,191,231 A * 3/1993 Berry ..... 307/142
5,283,475 A * 2/1994 Berger ..... 307/141.4
5,434,368 A * 7/1995 Hoffmann ..... 200/43.22
5,434,558 A * 7/1995 Zeder ..... 340/568.3
5,497,479 A 3/1996 Hornbuckle
5,525,965 A * 6/1996 Liebenthal ..... 340/568.3
5,541,664 A 7/1996 Cuadrado
5,621,387 A * 4/1997 Phillips et al. ..... 340/545.6
5,654,746 A 8/1997 McMullan, Jr. et al.
5,716,273 A 2/1998 Yuen
5,767,771 A * 6/1998 Lamont ..... 340/571
5,845,260 A 12/1998 Nakano et al.
5,964,661 A 10/1999 Dodge
5,973,683 A 10/1999 Cragun et al.
6,433,831 B1 8/2002 Dinwiddie et al.
6,469,615 B1 * 10/2002 Kady et al. ..... 340/5.1
6,519,208 B1 2/2003 DeVries
6,704,929 B1 3/2004 Ozer et al.
6,722,984 B1 4/2004 Sweeney, Jr. et al.
2002/0075760 A1 6/2002 DeVries
2003/0056209 A1 3/2003 Buck et al.
2004/0060059 A1 3/2004 Cohen
2004/0215909 A1 * 10/2004 Imai et al. ..... 711/163

* cited by examiner

*Primary Examiner*—Benjamin C. Lee
(74) *Attorney, Agent, or Firm*—Bellasco, Jacobs & Townsley L.L.P.; Norton Townsley

(57) ABSTRACT

A power distribution and timing device (PDTD) for controlling power supply to controlled device(s). This invention includes: an outlet; an alarm clock; a backup battery; a keyboard; a tamper switch; a display for showing day, time, modes of operation, programming steps, operational time remaining, warning signals and tamper attempts; and a microprocessor. The microprocessor includes: an integrated circuit for setting maintenance power to the controlled device(s); a program for securely programming the days and time periods when the controlled device(s) may be operated and the amount of time that the controlled device(s) may be operated; securely allowing power to the controlled device(s) to be increased to operating level when these time periods are not exceeded; and keeping power to the controlled devices at maintenance level when these time periods are exceeded. One or more of the outlets may be remote from the microprocessor and signals may be sent to such remote outlets via conventional means.

26 Claims, 17 Drawing Sheets

POWER DISTRIBUTION AND TIMING DEVICE

BACKGROUND OF THE INVENTION

1. Field of the Invention

The present invention relates generally to the management of the play or operation of one of more controlled devices, and, in particular, to a method and apparatus for controlling when and for how long each day such device(s) may be played.

2. Brief Description of the Related Art

Children in developed nations typically have unlimited access to electronic devices, e.g., television, gaming devices and consoles, personal computers, etc., that may not always contribute to their positive growth and development. Parents and educators have noted a rise in childhood obesity and may not always agree with the beliefs promoted by television programs and video games. Access to electronic devices is almost impossible to control when children are at home without parents or guardians. Access to electronic devices is actually difficult to control even when parents and guardians are at home. First, parents and guardians must be in the same room where their children are using the devices. When a parent or guardian estimates that any of their children are spending too much time utilizing any of these devices, they may be forced to discipline the child. Since the amount of time on these devices is rarely measured, discipline occurs at inconsistent times, generally dependent on the mood of the parent, and generally without objective information to support the discipline. As a result, discipline without any data creates a strain on the parent-child relationship, often yielding poor results.

A secondary problem that exists is the fact that, when entertainment device use is unlimited, children value it less. When it is limited, for example if a child can only spend 10 hours per week watching television, television viewing will become a more valued, and therefore more planned, use of time. Therefore, instead of the practice of "flipping" through television channels, children will be more likely to select a planned schedule of certain television programs, which will result in a more valuable entertainment experience.

The automatic control of a variety of multiple electronic devices and appliances is well known in the art. U.S. Patent Application Publication 2004/0060059 is directed to a method and apparatus for remotely controlling a plurality of devices. This apparatus includes a control mechanism which is in communication with multiple devices or software programs, applications, processes, or sub-processes resident on the devices. The control mechanism is in communication with the input mechanism. The input mechanism may include an alphanumeric keypad, touch-activated display device, or other devices capable of accepting input from a user and transmitting this input to the control mechanism. The control mechanism is also in communication with a visual display mechanism. The control mechanism may be located in a dedicated housing, together with the input mechanism and the visual display mechanism which may be mounted thereon. In alternative embodiments, the control mechanism may exist as a program on a separate device, such as a television set, a personal computer, a hand-held computer, a computing device, etc.

In the preferred embodiment, the apparatus includes a control mechanism having a memory and a configurable database. This configurable database allows for the input, modification, deletion, and output of various variable and values, namely, multiple user accounts, device identification values unique to each device, and device usage allotment values for each device corresponding to the device identification value for each user account. The control mechanism further includes a user interface which would allow the parent or guardian to set the settings for each user (child). In the preferred embodiment, the control mechanism allows for user names, user types, week day hours, weekend hours, password changing, bonus allowances, use restriction, user deletion, device selection, time or date selection and modification, time carryover options, hours per device, setup password changing, user statistics, etc.

U.S. Pat. No. 5,964,661 is directed to an apparatus and method for timing video games. The video game timer is interposed between the video game power supply and the video game console. The video game timer serves to interrupt the power supply to the video game console. The video game timer is plugged into the power input jack of the video game console and the video game power supply is plugged into the power input jack of the video game timer. A solid state switch of the video game timer, turns the power to the video game unit on and off. This switch is controlled by a microcontroller in the video game timer, as shown in. The microcontroller further polls to determine if there are any inputs from the twelve key keyboard and keeps track of time from a twenty-four hour counter. A small audio transducer is used to provide feedback to the user, specifically a tone is transmitted in response to input on keyboard and the audio transducer also provides a warning beep five seconds before power is turned off to the video game console.

U.S. Pat. No. 4,510,623 is directed to a television channel lockout. The microprocessor controls the channel which the television is tuned into. The microprocessor receives commands from the user via the control panel keyboard or the remote transmitter. When a keyboard entry is made, microprocessor checks to determine whether the four-digit master key has been entered. If not, the microprocessor then checks to determine whether the channel has been entered. If not, the microprocessor checks the EPROM to determine if the entered channel bit is "high" indicating that the channel is locked out. If that channel is not locked out, the microprocessor mutes the audio, blanks the channel number display and loads the PLL with the required programmable constant for the channel number selected. If the channel selected was a locked out channel, the flow diagram proceeds from connector A in A to the same connector in B. Having determined that the channel selected is a locked out channel, the microprocessor causes the display to blink the selected channel number for five seconds. If during that time, no four-digit code is entered or the correct four-digit security code is not entered, microprocessor will cause the display to display the last channel number and then go into the idle mode. A locked out channel cannot be watched for the next twelve hours unless the correct four-digit security code is used.

U.S. Pat. No. 5,654,746 is directed to a secure authorization and control method and apparatus for a game delivery service. The transaction control unit (TCU) receives transaction data from a decoder, interprets received transactions and performs other functions. The TCU further includes RAM and ROM memory. It further manages the authorization maps and operates game timers. The various game timers include parental control, playtime and the like, and may be decremented in ten second intervals.

U.S. Pat. No. 6,722,984 is directed to a game controller with parental control functionality. One implementation of a parental time limit feature includes setting a parental limit flow chart and monitoring and limiting play time flow chart.

In this example, the limit is expressed as a maximum number of hours per day that the game controller may be used. The controller counts down the time that is actively in use via an algorithm that assumes that a ten-second period without any button press activity means that the unit is no longer active. When the countdown value reaches zero, the controller no longer responds to button presses. At the start of each new day, the daily limit value is automatically reinstated to the parentally set value. Further, the system may provide a "warning" signal such as a beep or a flashing LED a short interval prior to complete expiration of the limit value. Further, a small LCD display could be provided on the controller to show remaining time allocation.

U.S. Pat. No. 5,125,492, U.S. Pat. No. 5,497,479, U.S. Pat. No. 5,541,664, U.S. Pat. No. 5,716,273, U.S. Pat. No. 5,845,260, U.S. Pat. No. 5,973,683, U.S. Pat. No. 6,433,831, U.S. Pat. No. 6,519,208, U.S. Pat. No. 6,704,929, U.S. Patent Application No. 2002/0075760, and U.S. Patent Application No. 2003/0056209 are all directed to similar systems Development of a power distribution and timing device which can control the time period and total time that a controlled device can operate each day, provide maintenance power to the device, and securely prevent tampering with the device represents a great improvement in the field play time control and satisfies a long felt need of parents and guardians

SUMMARY OF THE INVENTION

The present invention is a power distribution and timing device (PDTD) for controlling power supply to controlled device(s). This invention includes: an outlet for (a) accepting a power plug and cord from, and (b) supplying power to the controlled device(s); an alarm clock for alerting a user when a pre-set time has been reached; a backup battery for providing power to the PDTD when the PDTD is disconnected from mains power; a keyboard for allowing entry of a security code and programming of the PDTD; a tamper circuit and tamper switch for detecting when the PDTD has been tampered with; a display for showing day, time, modes of operation, programming steps, operational time remaining, warning signals and tamper attempts; and a microprocessor.

The microprocessor includes:

an integrated circuit for setting for setting maximum allowable power draw (maintenance level) when the controlled device(s) is/are not operating;

a program for:

securely programming the days and time periods (allowable time period) when the controlled device(s) may be operated and the amount of time (total time) that the controlled device(s) may be operated (normal operation mode);

securely allowing power to the controlled device(s) to be increased to operating level (override mode); and securely keeping power to the controlled device(s) to maintenance level (restrict mode);

an integrated circuit for setting, turning on and turning off the alarm clock;

an integrated cicuit for recharging the backup battery as needed when the PDTD is connected to mains; and an integrated circuit for:

determining the mode of the program;

if the mode is normal operation mode:

if the current day and time are within the allowable time period and the total time has not been exceeded, allowing power to the controlled device(s) to increase to operating level, detecting that current draw has been increased to operating level, and decrementing the count down timer whenever a user turns the controlled device(s) on;

as the current day and time approaches the end of the allowable time period, issuing a warning signal;

as the end of the total time period approaches, issuing a warning signal;

at the end of the allowable time period, decreasing power to the controlled device(s) to maintenance level; and at the end of the total time period, decreasing power to the controlled device(s) to maintenance level;

if the program is in override mode, allowing power to the controlled device(s) to increase to operating level; and if the program is in restrict mode, keeping power to the controlled device(s) at maintenance level;

When the power cord is disassemblable from the controlled device(s), i.e. the power cord has a second plug which plugs into a receptacle on the device(s), the invention further comprises an additional means for indicating whether the power cord has been disassembled from the controlled device(s).

An appreciation of the other aims and objectives of the present invention and an understanding of it may be achieved by referring to the accompanying drawings and description of a preferred embodiment.

BRIEF DESCRIPTION OF THE DRAWINGS

FIG. 8 is a flow chart illustrating what happens if the invention is tampered with.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
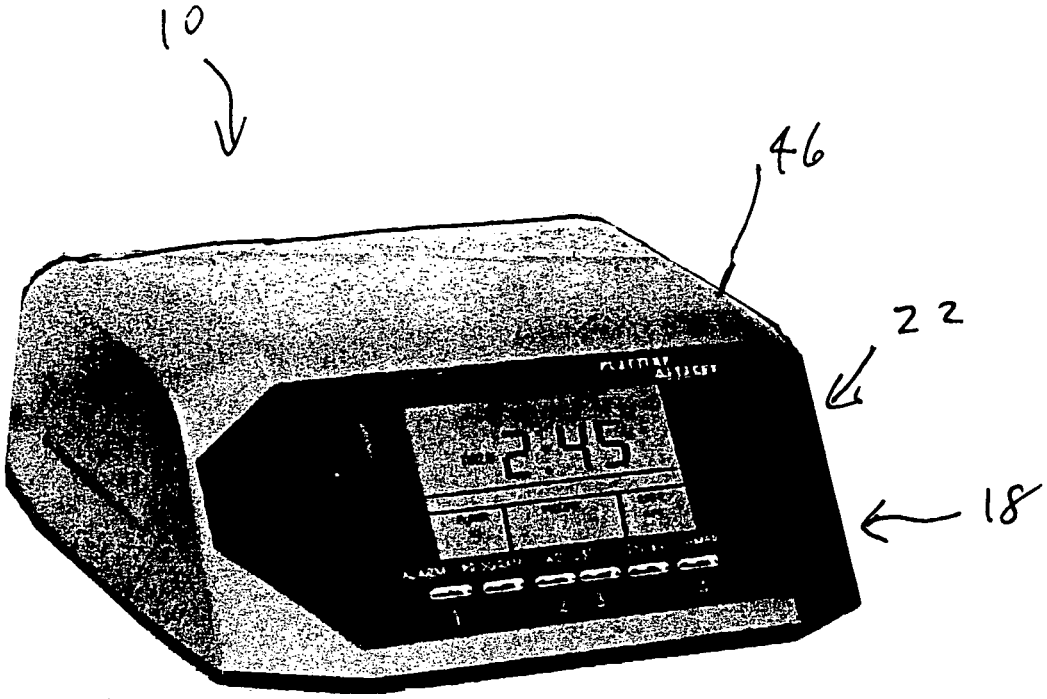
FIG. 1 is a front perspective view of this invention showing the case, the display and the keypad.
Figure 2:
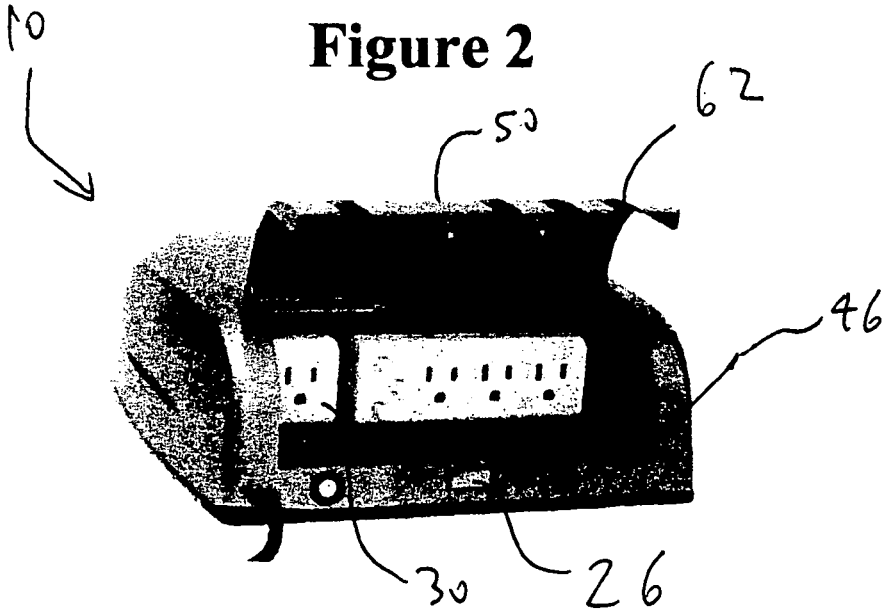
FIG. 2 is a real perspective view of this invention with the rear door open and showing the electrical receptacles and tamper switch.
Figure 3:
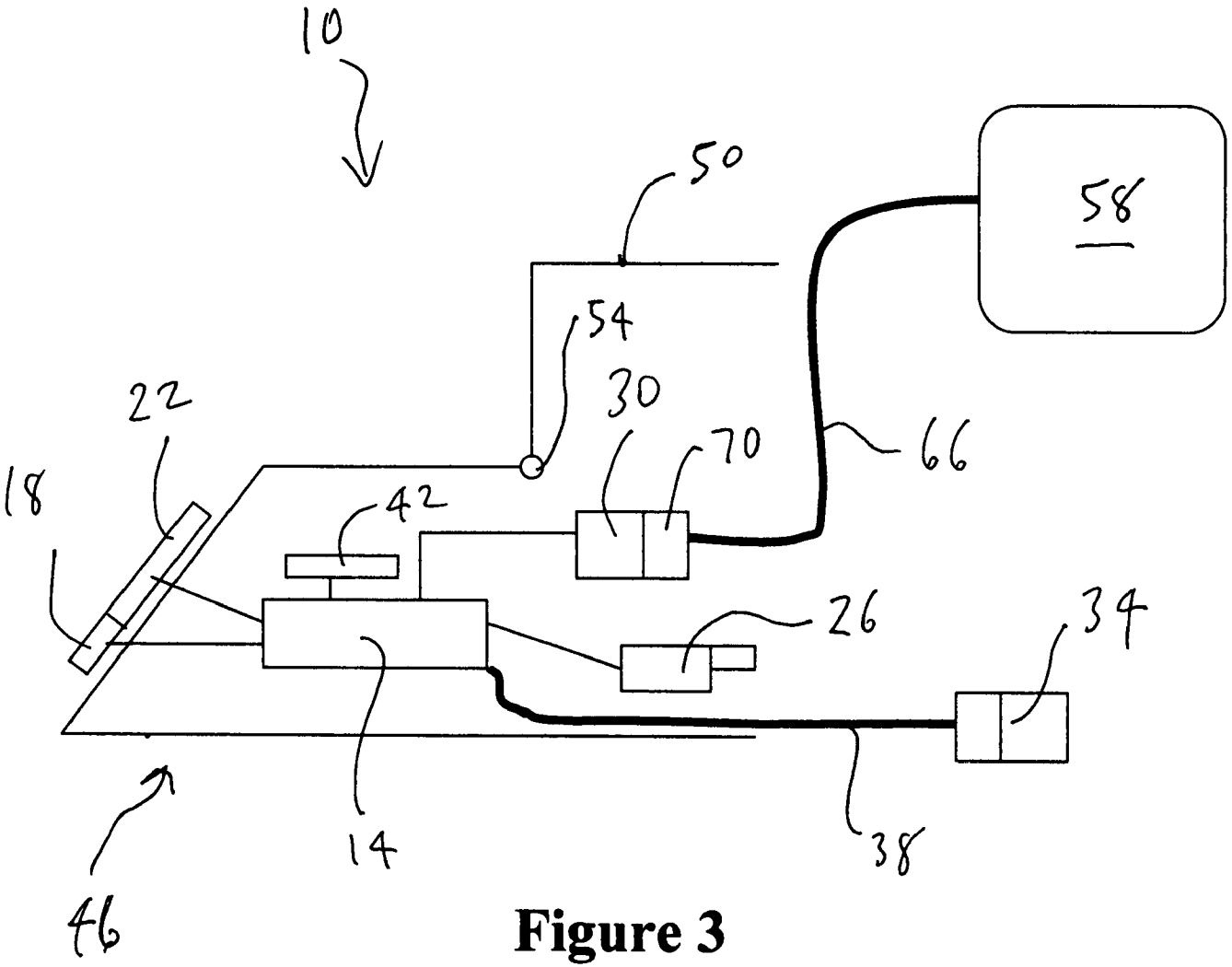
FIG. 3 is a block diagram of the most important elements of this invention.

Referring to FIGS. 1, 2 and 3, it will be seen that this invention 10 comprises a microprocessor 14 connected to a keyboard 18, a display 22, a tamper switch 26 and a receptacle 30. Power is supplied to the microprocessor either from the mains, via a plug 34 and power cord 38, or from a rechargeable, backup battery 42. Any kind of commercially available tamper switch 26 (such as a reed switch, or spring loaded switch) can be used. The invention 10 is contained within a case 46 which includes a rear, receptacle access door 50. The case 46 is assembled with tamper proof screws (not illustrated). Tamper proof screws are well known in the art. The head of a tamper proof screw is designed so that it can be inserted with a common screwdriver but not removed with a common screwdriver.

The door 50 is attached to the case 46 with a hinge 54 and co-operates with the tamper switch 26 to provide a tamper signal to the microprocessor 14. The device whose operation it is desired to control (controlled device) 58 is plugged in to the receptacle 30 within the case 46 via a plug 70 and power cord 66. The door 50 has a keyway 62 so that the power cord 66 for the controlled device 58 can exit the case 46 while its plug 70 is trapped behind the closed door 50. The preferred embodiment of this invention 10 will control a single device 58. An alternate embodiment 10 will have several receptacles 30 for controlling several devices 58.

The microprocessor 14: contains a default security code, operational program, day and time clock, and countdown timer; controls the display 22; allows reprogramming of the security code and operational program; allows for the clock to be securely set; starts and stops the timer; senses current to the controlled device 58; supplies maintenance power to the controlled device 58; switches power to operational level for the controlled device 58; detects opening of the tamper switch 26 via a tamper circuit; provides visible (via the display 22) and audible alerts; controls charging of the backup battery 42; allows programming of the alarm clock; and controls functioning of the alarm clock. Programming includes normal, restrict and override operation. Alerts include tamper, end of time limit and end of total time alerts.

Figure 4:
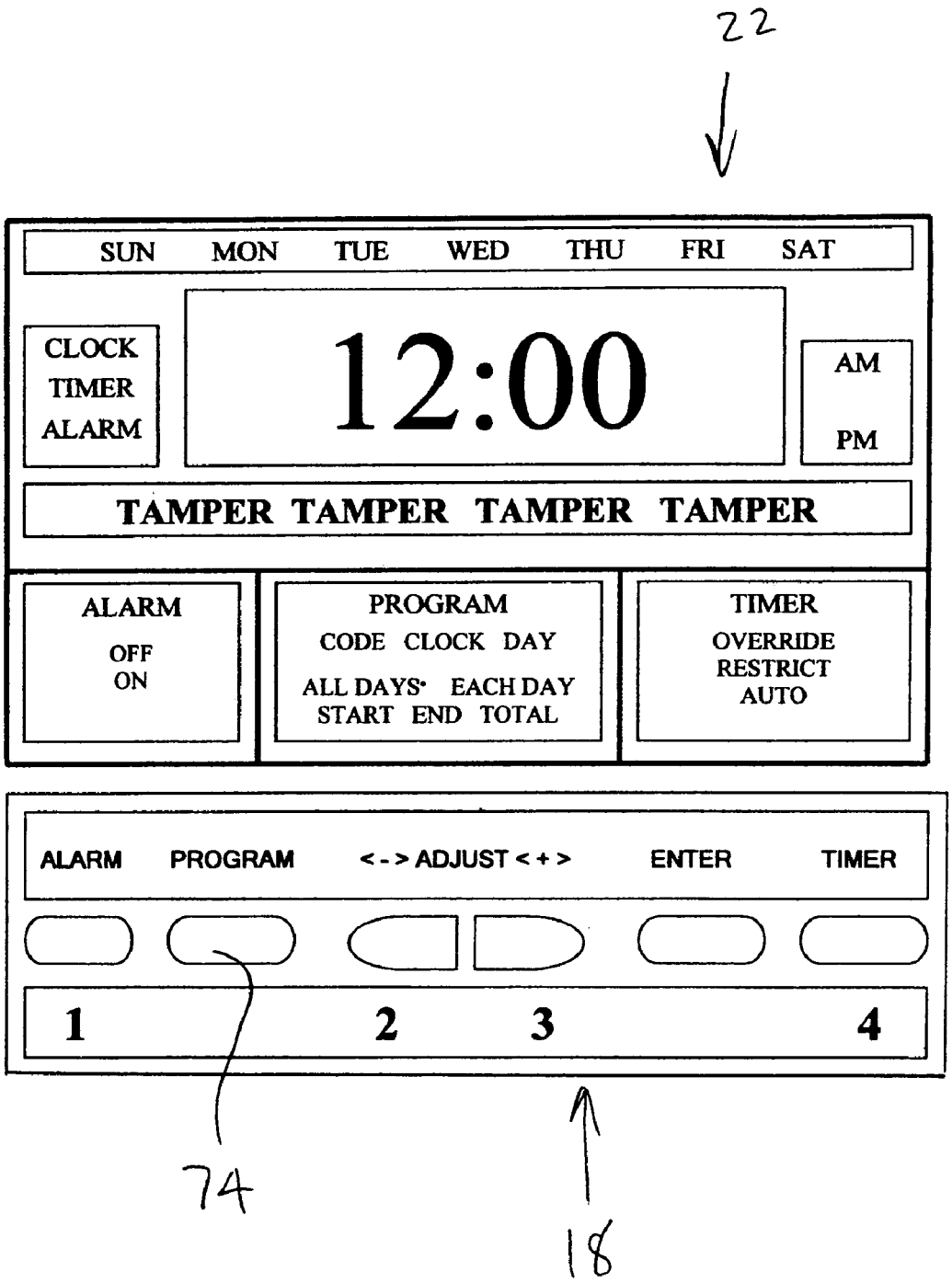
FIG. 4 illustrates the display and keypad of this invention

FIG. 4 illustrates the display 22 and keyboard 18. The functions of the buttons on the keyboard 18 are self evident and will become clearer from the description below. The display is preferably a backlit LCD display 22. The backlight remains on low intensity at all times for easy viewing at night and switches to high intensity during programming, alarm and alert modes, and whenever a controlled device 50 is being used.

Each function or mode is indicated in the display 22 and will begin to blink along with the corresponding characters when their programming is enabled. It will be clear that not all the markings on the display 22 are visible at all times. The markings that are visible at any time will become clearer from the description below.

A. Initialization

Figure 5:
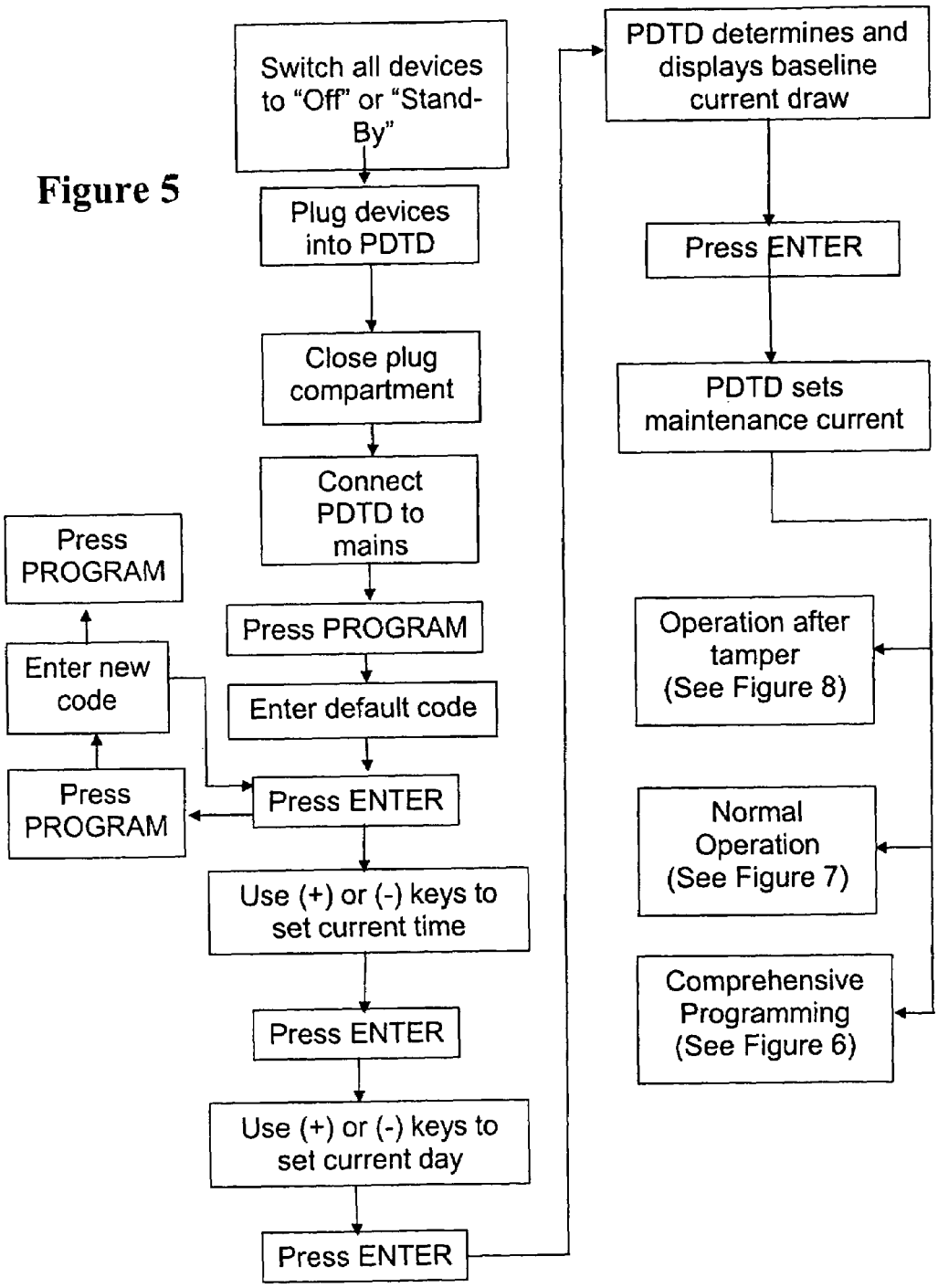
FIG. 5 is a flow chart showing initial set up of this invention.

FIG. 5 illustrates initializing the invention. To start, the controlled device(s) 58 are turned off. Then they are plugged into the receptacle(s) 30 and the plug compartment door 50 is closed. The PDTD 10 is plugged into mains and the current day and time are set. See B2 below. At this point, the unit 10 determines maintenance power. It is well known that many electrical devices draw a small amount of power when off in order to minimize the time it takes to turn on the device, keep LEDs lit, keep backup batteries charged, maintain clock settings, etc. For purposes of this invention, maintenance power is defined the current draw of the controlled device(s) 58 when they are turned off plus a small tolerance. The tolerance is preferably +5 to 15% to allow for fluctuations in line voltage. The unit 10 always supplies this maintenance power to the controlled device(s) 58. The circuit that determines current draw with the devices 50 off is simply an amp meter. The maintenance power is shown on the display 22. Then the unit 10 can be programmed (see B) or operated (see C). In addition the alarm may be set (see D).

B. Programming

A valid security code is required to enter programming mode. Functions are active and can be modified when they are blinking in the Display. The (+) (−) keys are used to adjust the programming forward or back and up or down. Pressing and releasing the (+) or (−) keys momentarily provides slow adjustments while holding the keys down will scroll the digits quickly. Any time any button is pressed on the keyboard the display goes from dim to bright in order to aid visibility. In addition all button presses are confirmed with an audible tone.

Figure 6:
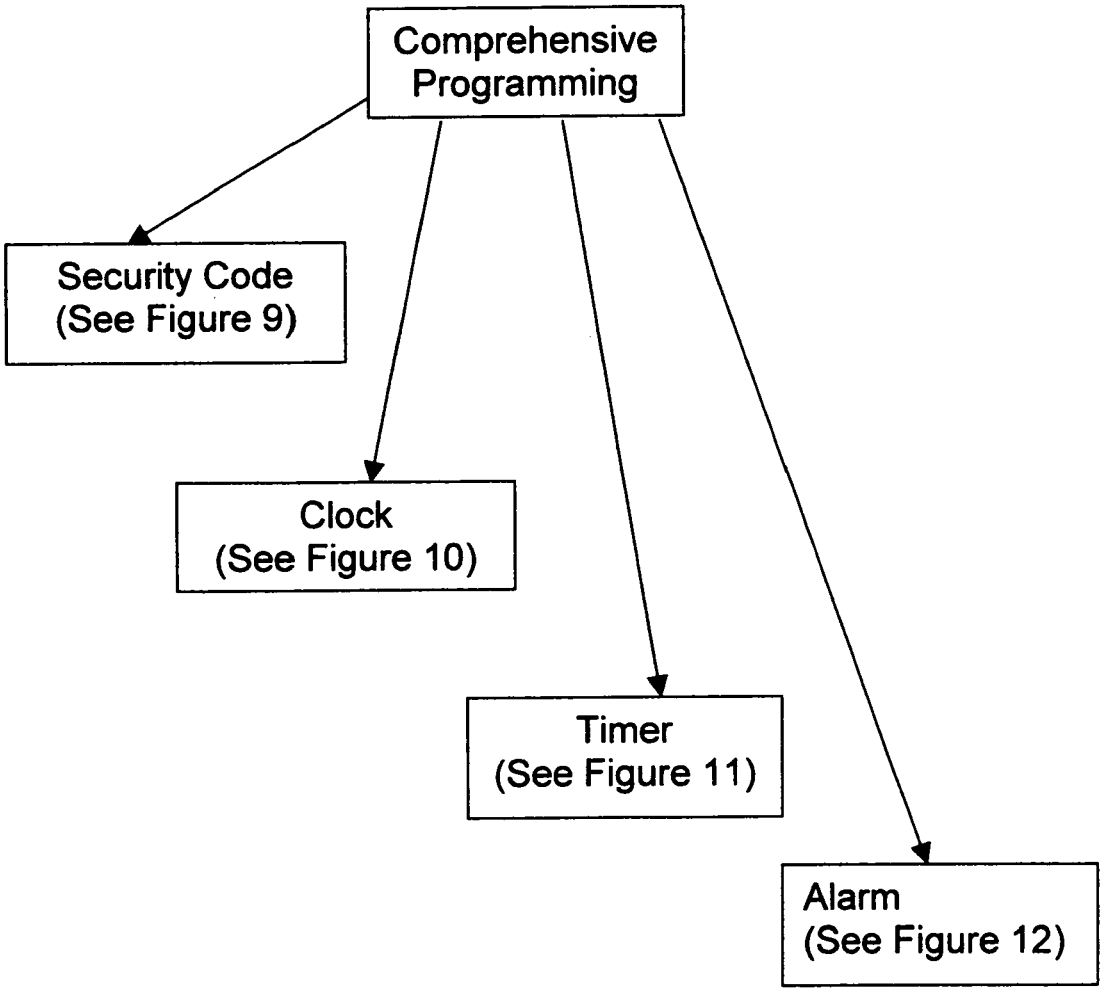
FIG. 6 is a flow chart showing the various programming functions that can be programmed for this invention.

The ENTER key must always be pressed after final adjustment to confirm the last entry or to scroll to the next function. If there is no activity for one minute, programming will time-out: this will require starting again. FIG. 6 illustrates the different kinds of programming that can be accomplished.

Figure 9:
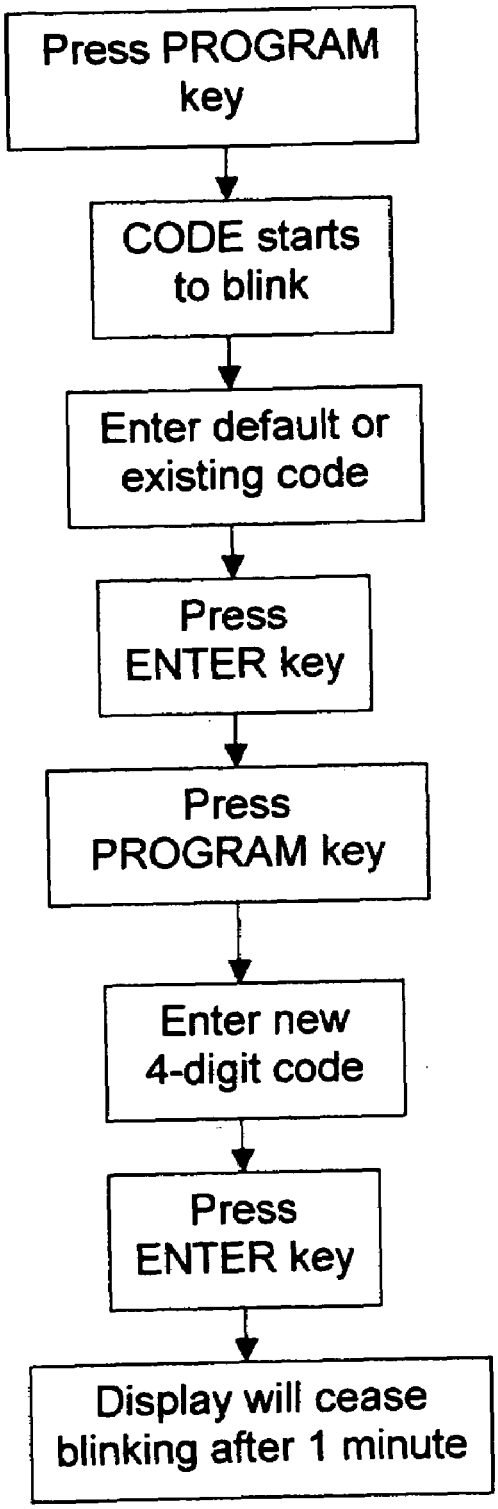
FIG. 9 is a flow chart illustrating programming a new code into the invention.
Figure 10:
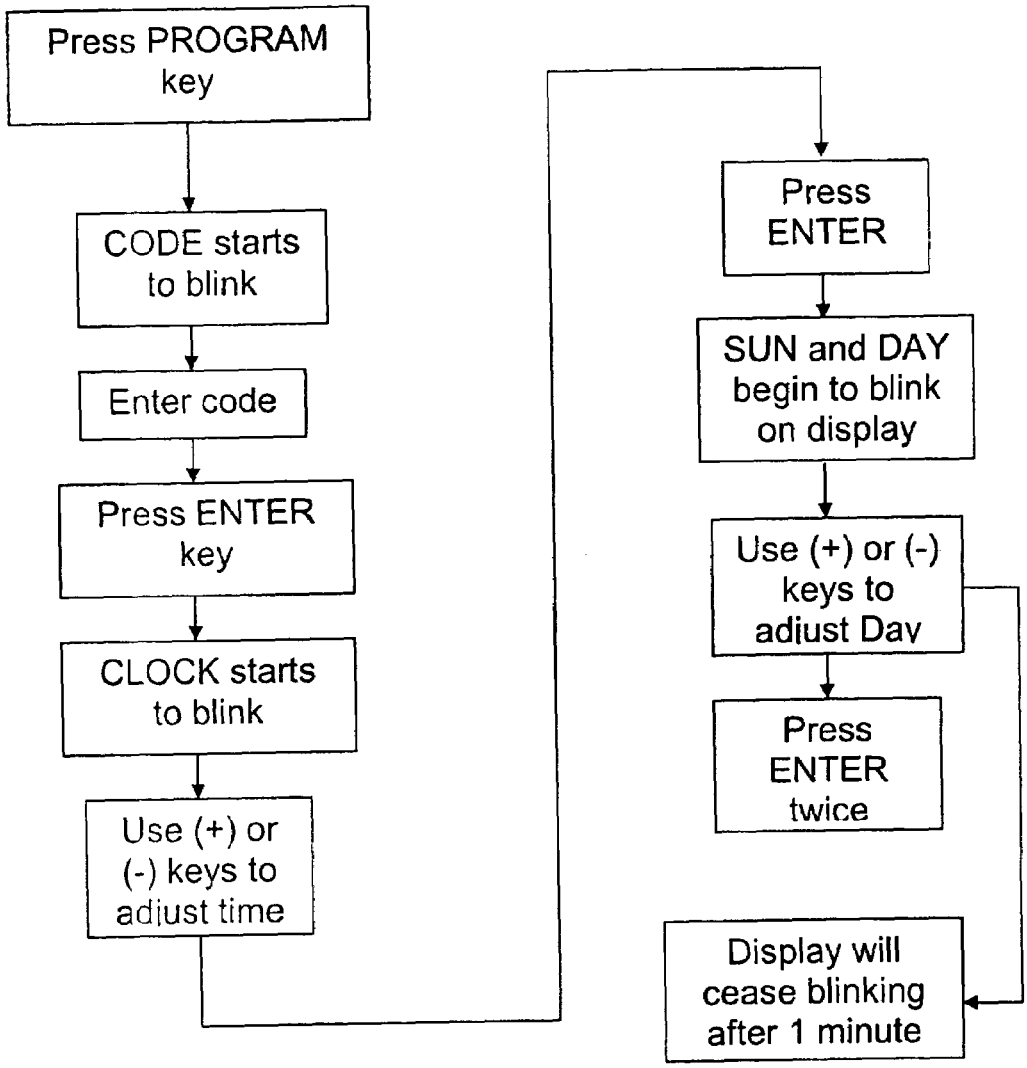
FIG. 10 is a flow chart illustrating setting of the clock.

1. Changing Security Code. The unit 10 is provided with a default four digit security code which is preferably "1234". For maximum security the default security code should be changed when the unit 10 is initialized. The new security code is, preferably, a four digit permutation of the numbers 1, 2, 3 and 4. More digits and higher numbers could easily be utilized for this invention but 256 different security codes are available with the preferred scheme. This plus the security features make having more than 256 different possibilities unnecessary. Preferably, a four digit number that is easy for the controlling party (the parent) to remember should be used and this should be changed frequently. To change the security code, the steps outlined in FIG. 9 are followed.
2. Setting the Clock. The clock is set and reset using the procedure shown on FIG. 10.
3. Setting the Timer. The microprocessor contains a default timer program, preferably as follows:

| | Allowable Time Period | | |
|---|---|---|---|
| Day | Start Time | End Time | Total Time |
| Sun | 7:30 AM | 8:30 PM | 4 Hours |
| Mon | 3:30 PM | 8:30 PM | 1 Hour 30 Minutes |
| Tue | 3:30 PM | 8:30 PM | 1 Hour 30 Minutes |
| Wed | 3:30 PM | 8:30 PM | 1 Hour 30 Minutes |
| Thu | 3:30 PM | 8:30 PM | 1 Hour 30 Minutes |
| Fri | 2:30 PM | 11:00 PM | 4 Hours |
| Sat | 7:30 AM | 11:00 PM | 4 Hours |

Alternatively the microprocessor 14 can be reprogrammed with a new timer program. The PDTD can be programmed with the same start and end times and total playtime for each day or programmed with varying start time, end time and total time for each day.

Figure 11:
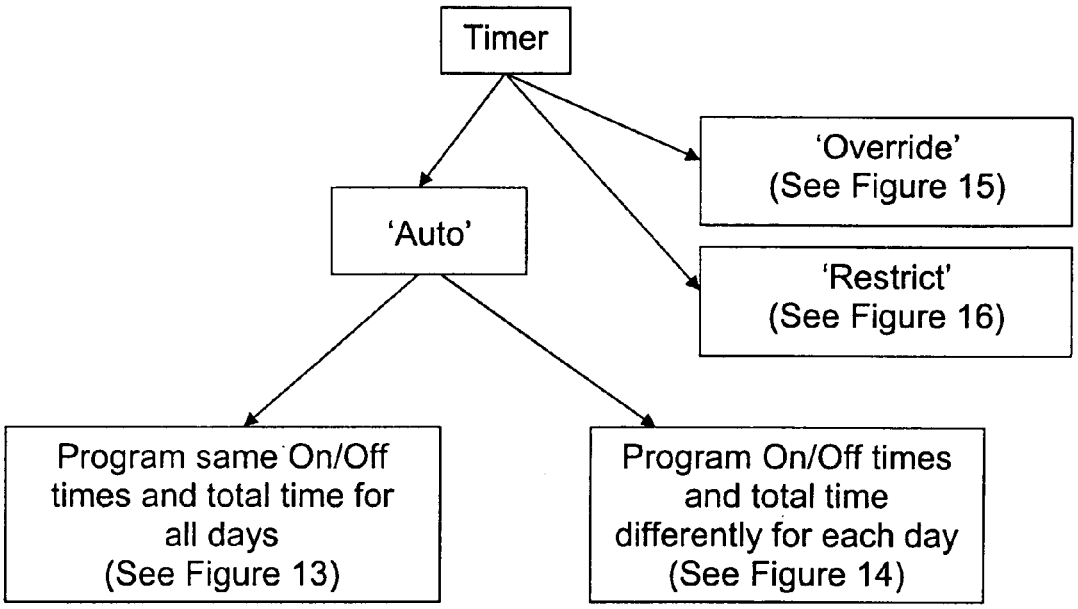
FIG. 11 is a flow chart illustrating the various methods for programming of the timer.
Figure 13:
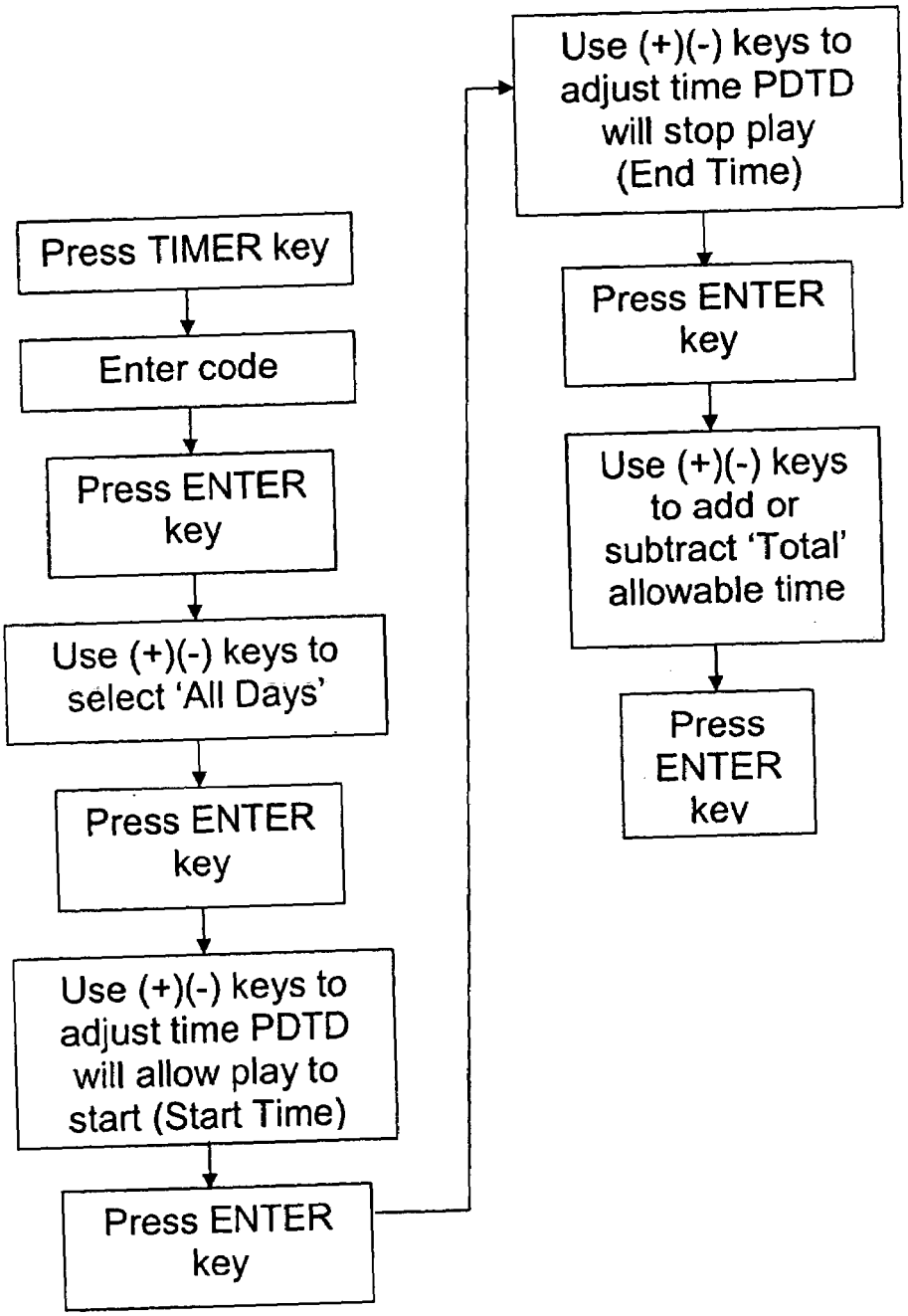
FIG. 13 is a flow chart showing programming of the timer to allow the same on/off times and the same total time for each day.
Figure 14:
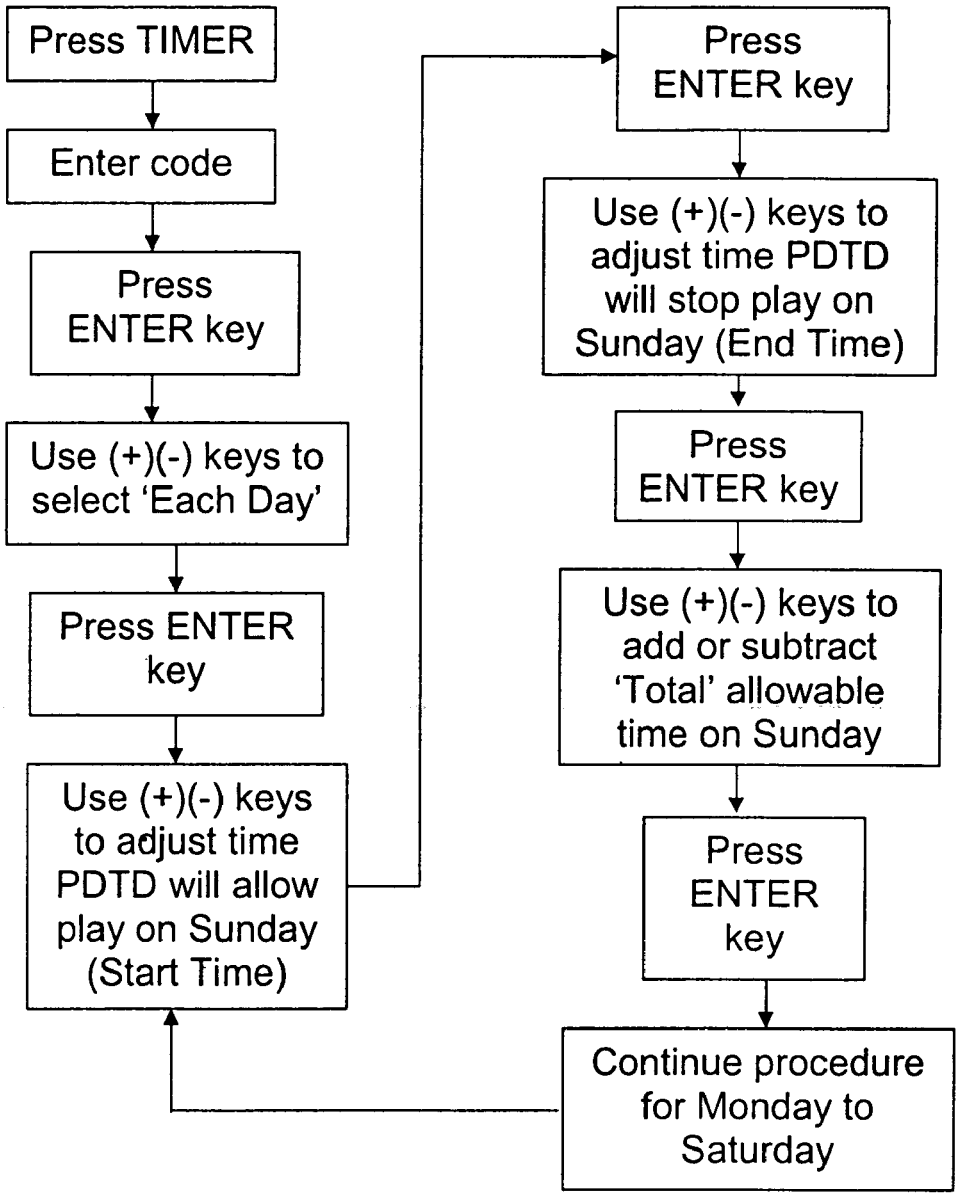
FIG. 14 is a flow chart showing programming of the timer to allow different on/off times and the different total times for each day.
Figure 15:
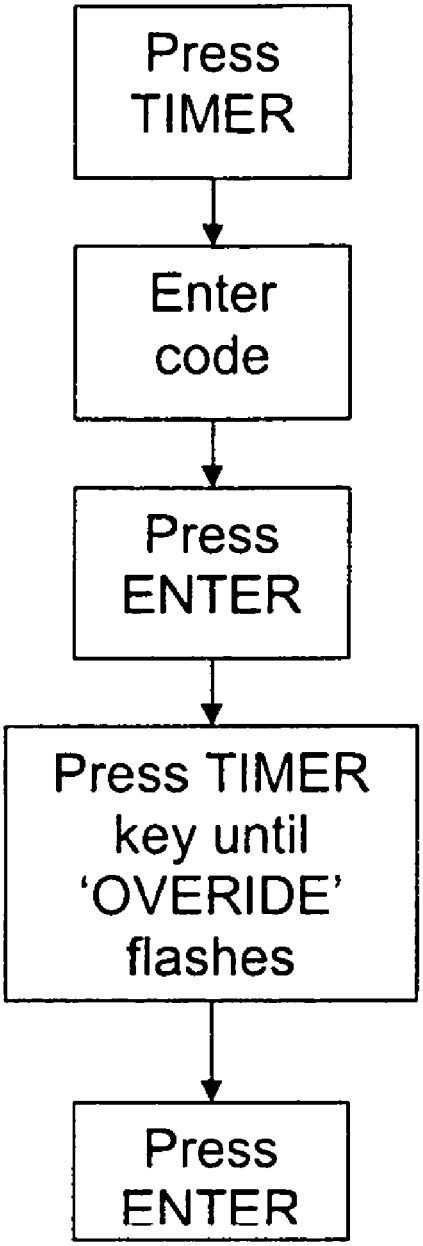
FIG. 15 is a flow chart showing how operation of the invention may be overridden: i.e. unrestricted operation of a connected device is allowed.
Figure 16:
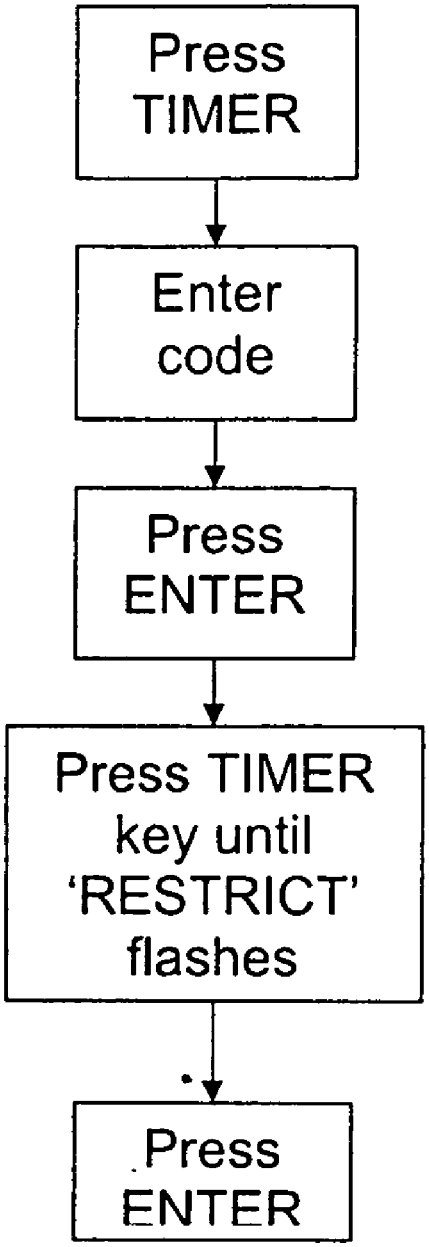
FIG. 16 is a flow chart showing how operation of the invention may be restricted: i.e. no operation of a connected device is allowed.

Pressing the TIMER key selects between the three operational modes of the Timer: Auto, Restrict, and Override. See FIG. 11. Auto mode allows operation during the allowable time periods and up to maximum total time. Auto mode is entered after following the programming steps of FIG. 13 or 14. Restrict mode allows no operation of the device(s) at all and is entered after following the programming steps of FIG. 16. Override mode allows unlimited operation of the device(s) and is entered by following the programming steps of FIG. 15.

Figure 12:
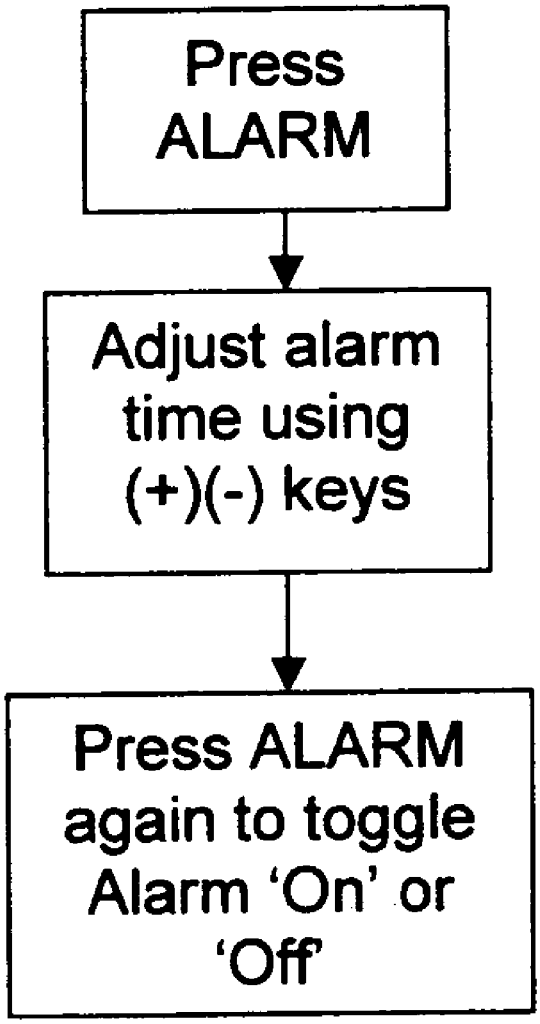
FIG. 12 is a flow chart showing how to set the alarm feature of the invention.

4. Alarm. Only the Alarm function can be programmed without the 4-digit security Code. Press the ALARM key once to display the current alarm set time. The displayed alarm time will be blinking and can be adjusted by using the (+) (−) keys. Each subsequent press of the ALARM key will toggle between ON and OFF on the display. See FIG. 12.

C. Normal Operation

Figure 7:
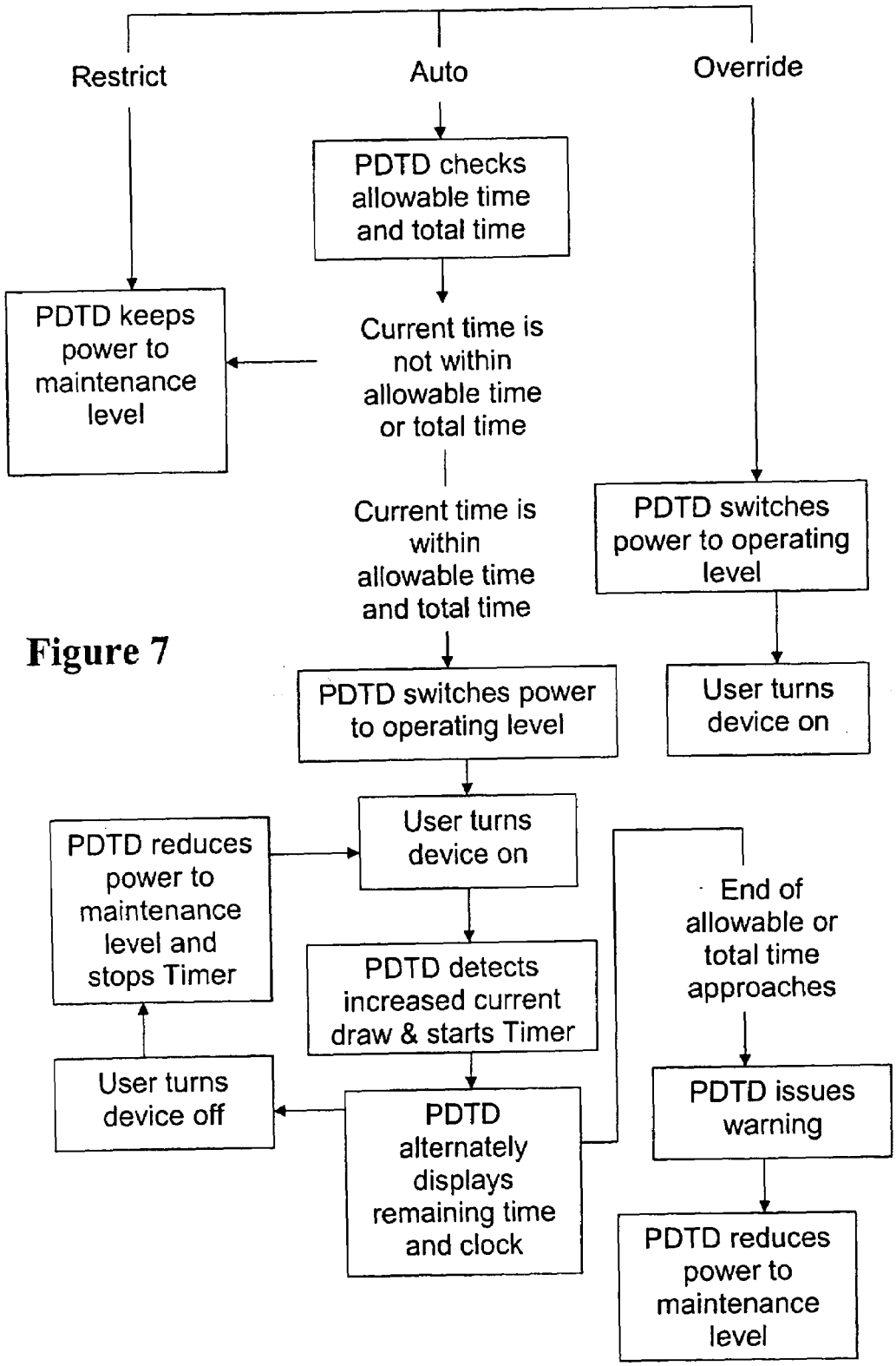
FIG. 7 is a flow chart showing the three modes of operation of this invention.

There are three separate programs running simultaneously: Clock, Timer, and Alarm. Normal operation proceeds as shown in FIG. 7 depending on what operational mode has been pre-programmed. Operational power to the device(s) 58 is only provided during the allowable time period each day and then only for the total time programmed.

Thus operation of the device(s) 58 can only commence between the programmed start and end times each day. The timer will begin the count down sequence when a controlled device 58 is switched on during an allowable time period. If the device 58 is turned off during the period, the timer will cease timing. The display 22 will continually display the clock time for ten seconds and then operational time remaining for three seconds between the start and end time.

When the timer approaches total time or end time an alert signal will be issued. Preferably the alert signal is flashing of the LCD backlight on the display 22 and sounding of an audible alarm. Preferably this will occur during the last 5 minutes remaining on the countdown timer. Preferably the frequency of the alerts will increase as the remaining time approaches 0:00. The following is the preferred schedule:

4:59–3:00 minutes remaining—alerts every 30 seconds

2:59–1:00 minutes remaining—alerts every 15 seconds

0:59–0:00 minutes remaining—alerts every 5 seconds.

Following this schedule allows the user to wind up operation of the device, saving progress on a game or computer, ejecting CDs, etc.

When end time is reached or total time reaches 0:00 for that day, the PDTD 10 will cease providing operational power to the device(s) 58 and revert to providing maintenance power.

D. Tamper Operation

Figure 8:
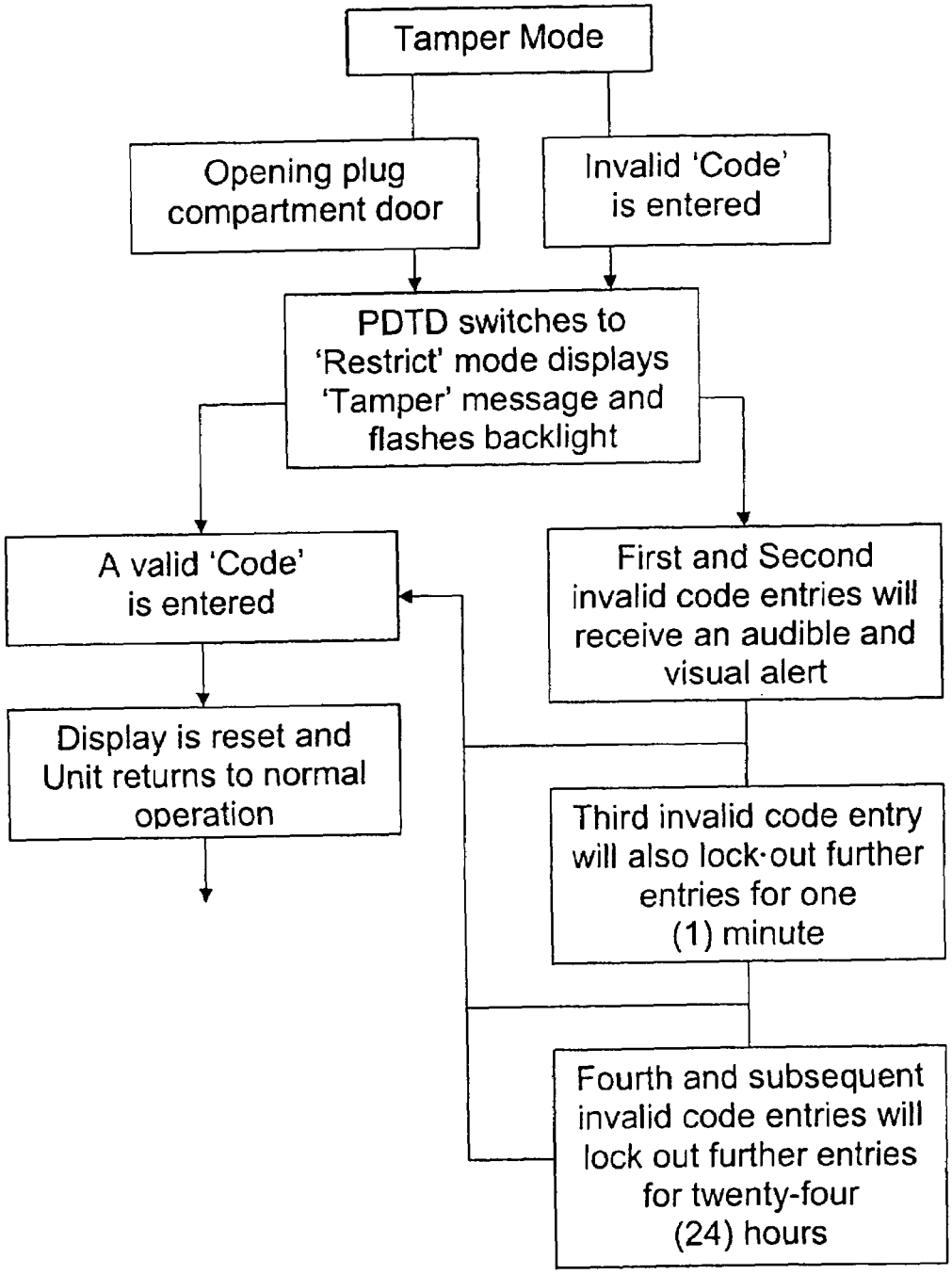

The unit 10 will go into tamper mode if the plug compartment door 50 is opened, thus triggering the tamper switch 26, or if an invalid code is entered during programming. Tamper operation is shown in FIG. 8. The plug compartment is electronically and mechanically tamper protected even during long-term power outages. Mechanical tamper protection is provided by the tamper proof screws which are used to assemble the case 46 as described above.

Upon opening the compartment door 50: the device will switch into Restrict mode and the display will begin to blink the Restrict and Tamper messages. A valid security Code is required to reset the display and return the Unit to normal operation.

When invalid codes are entered the microprocessor counts the number of attempts. When invalid codes are entered for the first and second times, an alert signal is issued. Preferably the alert signal is that Code, Tamper and Restrict messages and the LCD will begin to blink alternately between high and low intensity in the display 22. In addition on the third attempt the keyboard is locked for 1 minute. When an invalid code is entered for a fourth or subsequent time, the keyboard will be locked for 24 hours.

If the code has been forgotten or is not known the unit 10 must be reset. The only way to reset the invention 10 is to unplug the unit 10 from power and allow approximately 10 days for the backup battery to become depleted. After this, when power is reapplied all default settings will be restored and the backup battery will be re-charged.

E. Tamper Evident Seals

Figure 17:
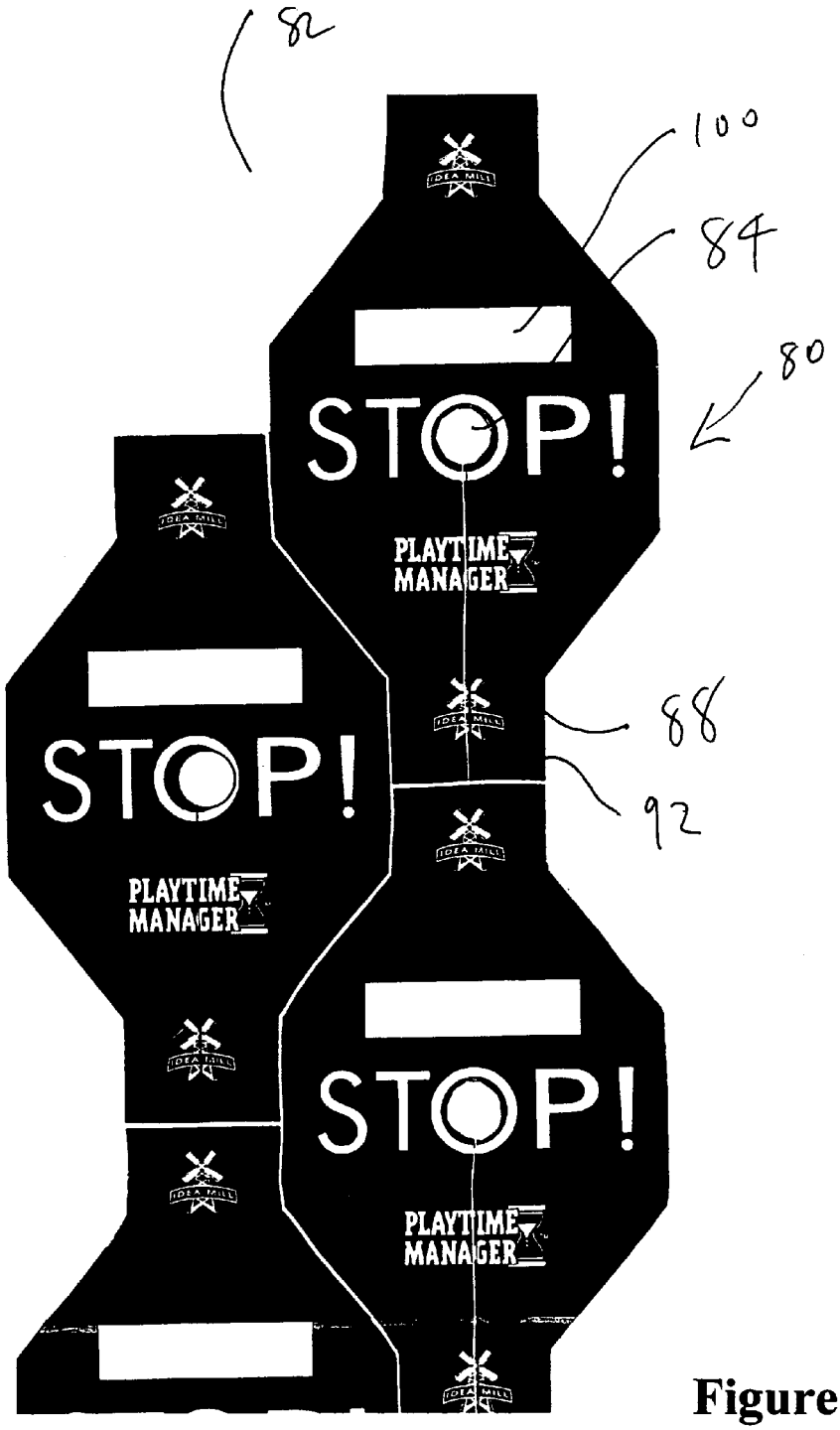
FIG. 17 is a flow chart illustrating the tamper evident seal of this invention.
Figure 18:
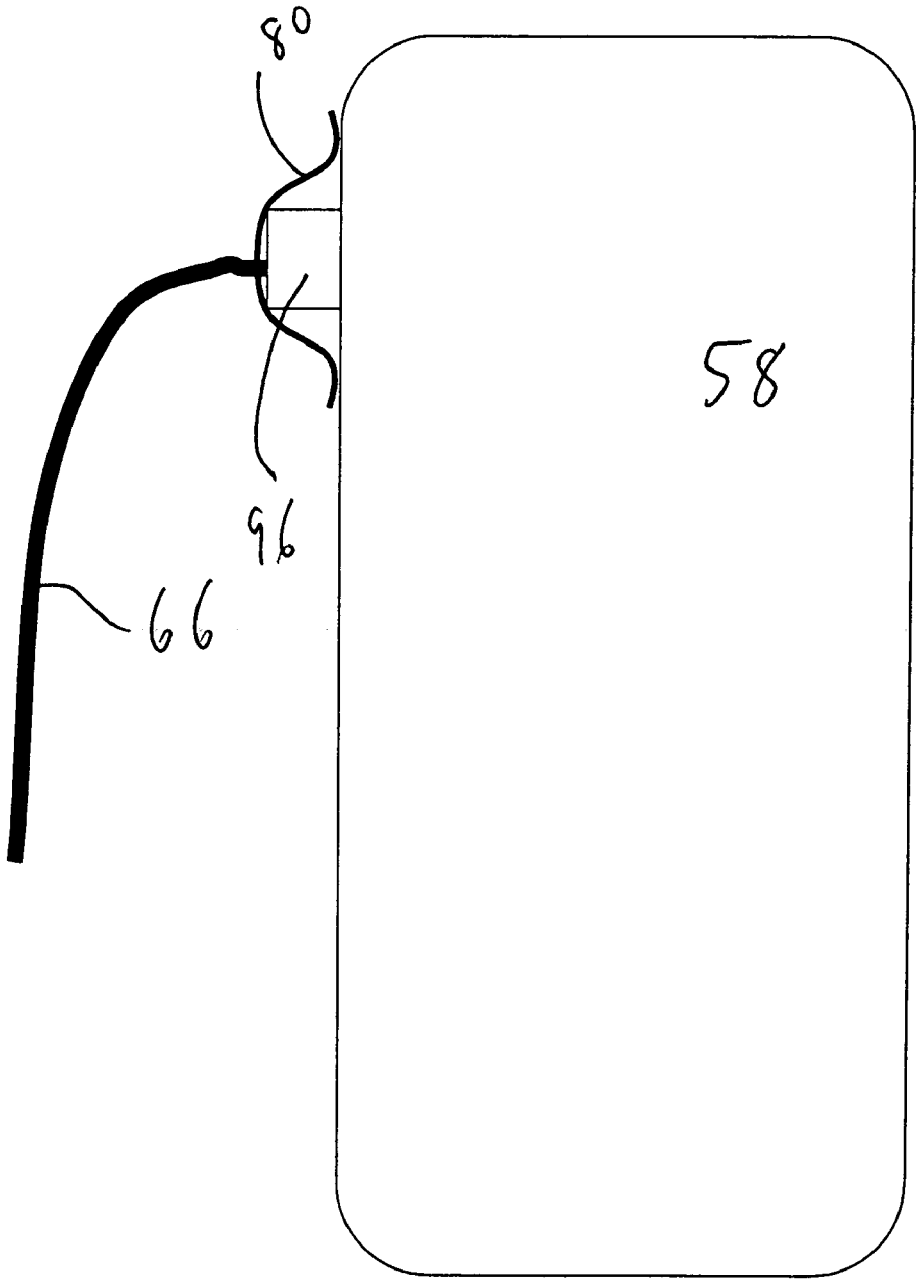
FIG. 18 is a sketch showing use of the tamper evident seal of this invention.

Most computers, printers, some televisions, etc. have removable power cords 66. This would allow unplugging of the device 58 and connection directly to mains with an alternate power cord thus defeating the tamper protection of this invention 10. Therefore, this invention is further provided with a tamper evident seal 80. A number of such seals 80 are illustrated in FIG. 17. The seals 80 are an adhesive backed film (Preferably of plastic or paper) provided on a release paper 82 with a hole 84 through which the power cord 66 fits and a slit 88 running from the hole 84 to the edge 92 of the seal 80. The seal 80 is peeled off the release paper and fastened to the device 58 around the cord 66 and plug 96 as illustrated on FIG. 18. The seals 80 are made of a frangible film with an extremely high tack adhesive. The seals 80 may be printed with appropriate warnings and may contain a box 100 for the control person to annotate with initials or signature as an added measure of security. Any attempt to remove a seal 80 will result in destruction of the seal 80. It will readily be appreciated that a device 58 may not be unplugged without destroying the seal.

Thus it can be seen that this invention 10 allows a controlling party (e.g. a parent) to control when and for how long a user (e.g. a child) can operate a controlled device 58 (e.g. a television). All the controlling party has to do is plug the controlled device 58 into this invention 10, close the door 50, change the code, program the current day and time, and then program the time periods when the controlled device 58 can be operated and total time(s) for which the device 58 can be operated during each time period. In addition, if the device 58 can be disassembled from its power cord 66, the controlling party can affix a tamper evident seal 80, around the cord 66 and plug 96, where the cord 66 plugs into the device 58. Further, the user can program the device 10 so that it can function like a regular alarm clock.

Moreover, if desired and for the purpose of rewarding the child, the parent can put the PDTD 10 into override mode and thus allow the child to unlimited play with the controlled device(s) 58. If necessary and for discouraging or punishing bad behavior, the parent can put the PDTD 10 into restrict mode and thus disallow any play with the controlled device(s) 58.

Figure 19:
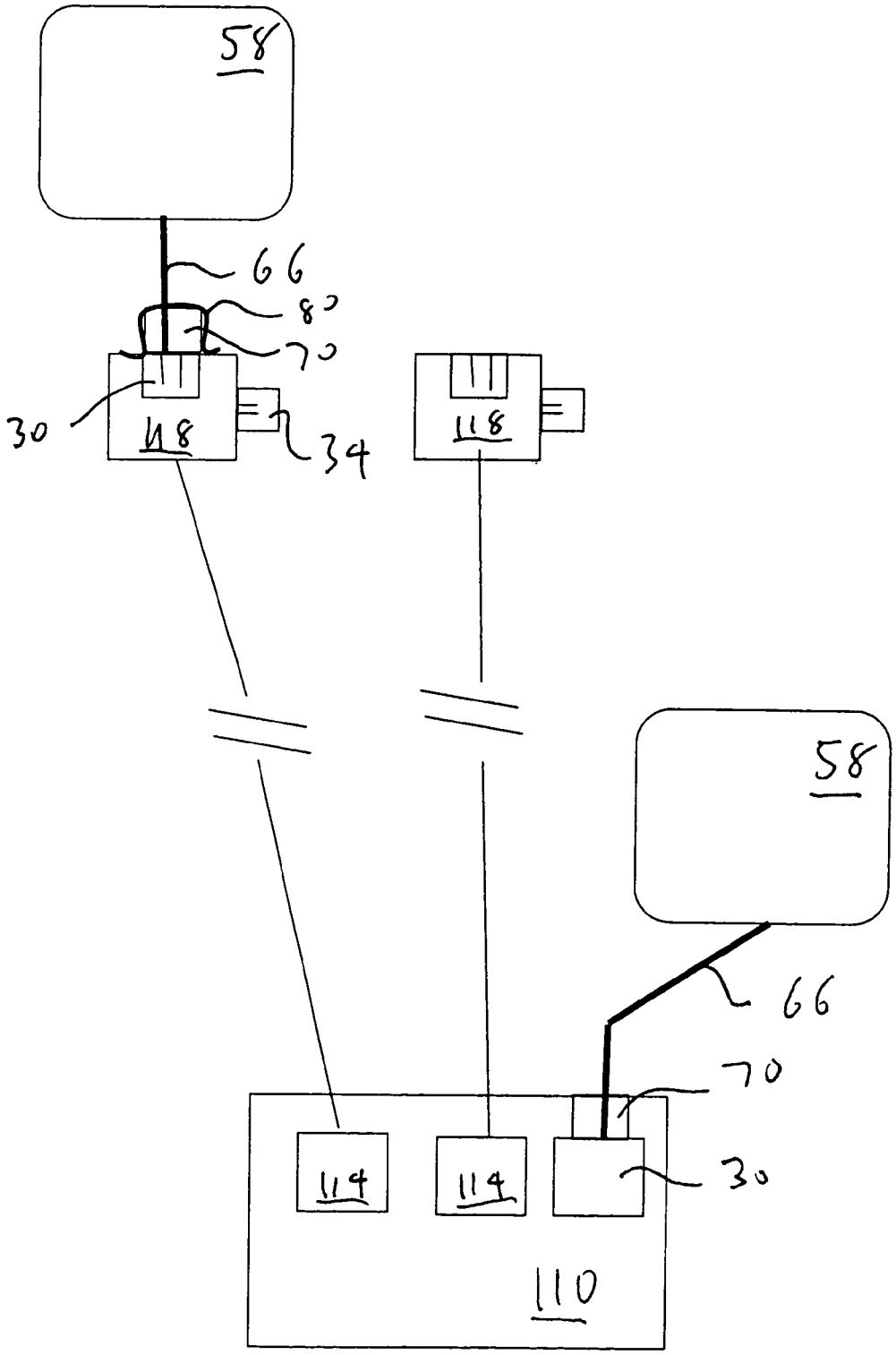
FIG. 19 is a sketch illustrating an alternate embodiment of this invention comprising a PDTD which controls one or more devices at a distance from the PTDT.

FIG. 19 illustrates an alternate embodiment of this invention 10. In this embodiment the PTDT 110 has one or more transmitters 114 instead of one or more receptacles 30. These transmitters 114 based on the programming described above, transmit an ON or OFF signal to a remote control 118. The remote control 118 plugs into mains via an outlet 34. In turn the device 58 plugs into a receptacle 30 in the remote. Preferably the signal transmitted from the transmitter 114 to the remote 118 is radio frequency. This would require the transmitter 114 to be a radio transmitter and the receiver 118 to be a radio receiver. The technology for secure transmission and reception of radio signals is well known and used in currently available WIFI devices, for example. Alternatively, the signal would be transmitted over standard house wiring. The technology for secure transmission and reception of signals over standard house wiring is also well known. A wide variety of products is currently available from X10, of Kent, Wash., for example. Of course, it would be easy for a user to remove the plug 70 from the receptacle 30 in the receiver 118, remove the receiver 118 from the wall outlet 34, and simply plug the device directly into the wall outlet 34. Thus a tamper evident seal 80 is placed around the plug 70 to ensure that it is not removed from the receiver 118.

The following reference numerals are used on FIGS. 1 through 19:

10 Power distribution and timing device (PDTD)
14 Microprocessor
18 Keypad
22 Display
26 Tamper switch
30 Receptacle
34 Power plug for PDTD
38 Power cord for PDTD
42 Backup battery
46 Case
50 Receptacle compartment door
54 Hinge
58 Controlled device
62 Keyway or slot in door
66 Power cord for controlled device
70 Power plug for controlled device
80 Tamper evident seal
82 Release paper
84 Hole in seal
88 Slit in seal
92 Edge of seal
96 Disassembable power plug for device
100 Writing area on seal
110 Alternate embodiment of PDTD
114 Transmitter
118 Receiver The following definitions are used in this application:

allowable time period—the period of time each day that the controlled device may be operated;

controlled device—a device that is controlled by this invention;

control person, control party, parent or guardian—the person who controls usage of the controlled device(s); i.e. the person who knows the security code, securely connects the controlled device(s) and programs the PDTD;

LCD—liquid crystal display;

LED—light emitting diode;

maintenance level or power—the level of power that all the devices controlled by this invention draw when they are OFF, plus a small tolerance;

operational level or power—the level of power that all the devices controlled by this invention draw when they are ON;

PDTD—power distribution and timing device, this invention;

play—operation of controlled device(s)

tamper proof screw—screw that can be inserted with a regular screwdriver but cannot be removed;

tamper switch—a switch whose state (open or closed) changes when an adjacent element (such as a surface or a magnet) is moved adjacent to or a short distance away from the switch;

total time—the time that the devices controlled by this invention may be operated during the allowable time period; and user, child—the person whose use of the controlled device(s) is controlled.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A power distribution and timing device (PDTD) comprising:

a) an outlet means for supplying power to a controlled device;

b) a backup power means for providing power to said PDTD when said PDTD is disconnected from mains power;

c) a microprocessor means for:

i) setting maintenance power;

ii) securely programming said PTDT; and iii) allowing operating power to said controlled device and decrementing a countdown timer whenever a user turns said controlled device on, if the current day and time are within the allowable time period and the total time has not been exceeded;

d) a keyboard means for programming said microprocessor means;

e) a tamper means for detecting when said PDTD has been tampered with; and f) a display means for showing day, time, modes of operation, programming steps, operational time remaining, warning signals and tamper attempts.

2. A PDTD as claimed in claim 1 in which said microprocessor means is also for allowing operating power to said controlled device if said microprocessor is in override mode.

3. A PDTD as claimed in claim 1 further comprising an alarm means for alerting a user when a pre-set time has been reached.

4. A PDTD as claimed in claim 1 in which said microprocessor means is also for issuing a warning signal as the current day and time approaches the end of the allowable time period and as the end of the total time period approaches.

5. A PDTD as claimed in claim 1 in which said microprocessor means is also for recharging said backup power means as needed.

6. A PDTD as claimed in claim 1 in which said microprocessor means is also for keeping power to said controlled device at maintenance level if said microprocessor is in restrict mode.

7. A PDTD as claimed in claim 1 further comprising a second tamper means for detecting when electrical connection to said controlled device has been tampered with.

8. A power distribution and timing device (PDTD) comprising:

a) an outlet means for;
  i) accepting a power plug and cord from; and
  ii) supplying power to
  a controlled device;
b) an alarm means for alerting a user when a pre-set time has been reached;
c) a backup power means for providing power to said PDTD when said PDTD is disconnected from mains power;
d) a setting means for setting maximum allowable power draw (maintenance level) when said controlled device is not operating;
e) a program means for:
  i) securely programming the days and time periods (allowable time period) when said controlled device may be operated and the amount of time (total time) that said controlled device may be operated (normal operation mode);
  ii) securely allowing power to said controlled device to be increased to operating level (override mode); and
  iii) securely keeping power to said controlled device to maintenance level (restrict mode);
  iv) setting, turning on and turning off said alarm means; and
  v) recharging said backup power means as needed when said PDTD is connected to mains;
f) a comparing means for:
  i) determining the mode of said program means; and
  ii) if said mode is normal operation mode:
    (1) if the current day and time are within the allowable time period and the total time has not been exceeded, allowing power to said controlled device to increase to operating level, detecting that current draw has been increased to operating level, and decrementing the countdown timer whenever a user turns said controlled device on;
    (2) as the current day and time approaches the end of the allowable time period, issuing a warning signal;
    (3) as the end of the total time period approaches, issuing a warning signal;
    (4) at the end of the allowable time period, decreasing power to said controlled device to maintenance level; and
    (5) at the end of the total time period, decreasing power to said controlled device to maintenance level;
  iii) if said program means is in override mode, allowing power to said controlled device to increase to operating level; and
  iv) if said program means is in restrict mode, keeping power to said controlled device at maintenance level;
g) a keyboard means for allowing entry of a security code, and programming said program means;
h) a tamper means for detecting when said PDTD has been tampered with; and
i) a display means for showing day, time, modes of operation, programming steps, operational time remaining, warning signals and tamper attempts.

9. A PDTD as claimed in claim 8, in which said power cord is disassemblable from said controlled device, further comprising a second tamper means for indicating disassembly of said power cord from said controlled device.

10. A PDTD as claimed in claim 8 in which said outlet means is adjacent said program means.

11. A PDTD as claimed in claim 8 in which said outlet means is remote from said comparing means, further comprising a signal means for transmitting an ON signal and an OFF signal from said comparing means to said outlet means.

12. A PDTD as claimed in claim 11 in which said second tamper means is a tamper proof seal.

13. A PDTD as claimed in claim 8 in which said outlet means is adjacent said comparing means further comprising:
a) a second outlet means for:
  i) accepting a power plug and cord from; and
  ii) supplying power to a controlled device; said second outlet means being remote from said program means;
  iii) a signal means for transmitting an ON signal and an OFF signal from said comparing means to said second outlet means; and
b) a second a tamper means for detecting when said device has been unplugged from said second outlet means.

14. A PDTD as claimed in claim 13 in which said tamper means is a tamper switch and said second tamper means is a tamper proof seal.

15. A PDTD as claimed in claim 10 in which said tamper means is a tamper switch.

16. A power distribution and timing device (PDTD) for controlling when and for how long a controlled device is allowed to operate comprising:
a) a power outlet adapted for electrical connection to said controlled device via a power cord;
b) an alarm clock;
c) a backup battery;
d) a keyboard;
e) a tamper switch;
f) a display; and
g) a microprocessor, connected to said power outlet, said alarm clock, said backup battery, said keyboard, said tamper switch and said display, designed to:
  i) detect and set maximum allowable power draw (maintenance level) when said controlled device is not operating;
  ii) allow secure programming of the security code, current time and day, and days and time periods (allowable time period) when said controlled device may be operated and the amount of time (total time) that said controlled device may be operated (normal operation mode);
  iii) allow secure allowance of power to said controlled device to increase to operating level (override mode); and
  iv) allow secure keeping of operating power to said controlled device at maintenance level (restrict mode);
  v) allow setting, turning on and turning off said alarm clock; and
  vi) allow recharging said backup battery as needed when said PDTD is connected to mains;
  vii) determine the mode of said microprocessor; and
  viii) if said mode is normal operation mode:
    (1) if the current day and time are within the allowable time period and the total time has not been exceeded, detecting that current draw has been increased to operating level, allowing power to said controlled device to increase to operating level and decrementing a countdown timer whenever a user turns said controlled device on;
    (2) as the current day and time approaches the end of the allowable time period, issuing a warning signal;
    (3) as the end of the total time period approaches, issuing a warning signal;

(4) at the end of the allowable time period, decreasing power to said controlled device to maintenance level; and (5) at the end of the total time period, decreasing power to said controlled device to maintenance level;

ix) if said microprocessor is in override mode, allowing power to said controlled device to increase to operating level; and x) if said microprocessor is in restrict mode, keeping power to said controlled device at maintenance level.

17. A PDTD as claimed in claim 16, in which said power cord is disassemblable from said controlled device via a plug at said outlet, further comprising an adhesive backed seal adapted to fit around said power cord and adhere to said controlled device around said plug and outlet.

18. A PDTD as claimed in claim 16, in which said power outlet is adjacent said microprocessor.

19. A PDTD as claimed in claim 16 in which said power outlet is remote from said microprocessor, further comprising a signal means for transmitting an ON signal and an OFF signal from said microprocessor to said power outlet.

20. A PDTD as claimed in claim 16 in which said power outlet is adjacent said microprocessor further comprising:

a) a second power outlet adapted for electrical connection to a second controlled device; said second power outlet being remote from said microprocessor;

b) a signal means for transmitting an ON signal and an OFF signal from said microprocessor to said second power outlet; and c) an adhesive backed seal adapted to fit around the power cord and plug of said second controlled device and adhere to said second power outlet.

21. A method for controlling power supply to a controlled device comprising the steps of:

a) providing a PDTD including: an alarm clock, a backup battery, a power outlet protected by a door with a tamper switch, and a microprocessor; said microprocessor including a program;

b) connecting said controlled device to said power outlet via a power cord;

c) detecting by said microprocessor of non-operational power draw when said controlled device is not operating;

d) setting by said microprocessor of maintenance power to be non-operational power plus a small tolerance;

e) providing by said microprocessor of maintenance power to said controlled device at all times;

f) securely programming in said microprocessor of days and time periods (allowable time period) when said controlled device may be operated and the amount of time (total time) that said controlled device may be operated (normal operation mode);

g) securely allowing by said microprocessor of power to said controlled device to increase to operating level (override mode);

h) securely keeping by said microprocessor of operating power to said controlled device at maintenance level (restrict mode);

i) setting, turning on and turning off by said microprocessor of said alarm clock;

j) recharging by said microprocessor of said backup battery as needed when said PDTD is connected to mains;

k) determining by said microprocessor of the programmed mode;

l) if said mode is normal operation mode:

i) if the current day and time are within the allowable time period and the total time has not been exceeded, detecting that current draw has been increased to operating level, and allowing power to said controlled device to increase to operating level whenever a user turns said controlled device on;

ii) as the current day and time approaches the end of the allowable time period, issuing a warning signal;

iii) as the end of the total time period approaches, issuing a warning signal;

iv) at the end of the allowable time period, decreasing power to said controlled device to maintenance level; and v) at the end of the total time period, decreasing power to said controlled device to maintenance level;

m) if said microprocessor is in override mode, allowing power to said controlled device to increase to operating level; and n) if said microprocessor is in restrict mode, keeping power to said controlled device at maintenance level.

22. A PDTD as claimed in claim 21, in which said power cord is disassemblable from said controlled device via a plug at an outlet, further comprising the steps of:

a) providing an adhesive backed seal adapted to fit around said power cord;

b) fitting said adhesive backed seal around said power cord adjacent said plug;

c) adhering said adhesive backed seal to said controlled device around said plug and outlet.

23. A method as claimed in claim 21 in which said tolerance is 5 to 15 percent.

24. A PDTD as claimed in claim 21 in which said power outlet is adjacent said microprocessor.

25. A PDTD as claimed in claim 21 in which said power outlet is remote from said microprocessor, further comprising the steps of:

a) transmitting an ON signal from said microprocessor to said power outlet; and b) transmitting an OFF signal from said microprocessor to said power outlet.

26. A PDTD as claimed in claim 21 in which said power outlet is adjacent said microprocessor further comprising the steps of:

a) providing a second power outlet adapted for electrical connection to a second controlled device; said second power outlet being remote from said microprocessor;

b) transmitting an ON signal from said microprocessor to said second power outlet; and c) transmitting an OFF signal from said microprocessor to said second power outlet;

d) providing an adhesive backed seal adapted to fit around the power cord and plug of said second controlled device and adhere to said second power outlet; and e) adhering said adhesive backed seal around the power cord and plug of said second controlled device and to said second power outlet.

* * * * *